US010011112B2

(12) United States Patent
Takagi

(10) Patent No.: US 10,011,112 B2
(45) Date of Patent: Jul. 3, 2018

(54) LIQUID DISCHARGE HEAD SUBSTRATE, LIQUID DISCHARGE HEAD, AND RECORDING APPARATUS

(71) Applicant: CANON KABUSHIKI KAISHA, Tokyo (JP)

(72) Inventor: Makoto Takagi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/634,895

(22) Filed: Jun. 27, 2017

(65) Prior Publication Data

US 2018/0001632 A1 Jan. 4, 2018

(30) Foreign Application Priority Data

Jun. 30, 2016 (JP) ..... 2016-130908

(51) Int. Cl.
*B41J 2/14* (2006.01)
*B41J 2/045* (2006.01)

(52) U.S. Cl.
CPC ..... *B41J 2/1433* (2013.01); *B41J 2/04541* (2013.01); *B41J 2/14072* (2013.01); *B41J 2/0458* (2013.01); *B41J 2/04543* (2013.01); *B41J 2002/14491* (2013.01)

(58) Field of Classification Search
CPC ..... B41J 2/1433; B41J 2002/14491; B41J 2/14072; B41J 2/04541; B41J 2/04543; B41J 2/0458
See application file for complete search history.

(56) References Cited

U.S. PATENT DOCUMENTS 8,721,047 B2 * 5/2014 Sakurai ..... B41J 2/1404 347/50
9,278,518 B2 * 3/2016 Fujii ..... B41J 2/04541
2008/0129781 A1 * 6/2008 Furukawa ..... B41J 2/04515 347/50
2012/0274703 A1 * 11/2012 Tsuchii ..... B41J 2/1404 347/40
2016/0214384 A1 * 7/2016 Kasai ..... B41J 2/14072

FOREIGN PATENT DOCUMENTS

JP 2015-096318 A 5/2015

* cited by examiner

*Primary Examiner* — Henok Legesse
(74) *Attorney, Agent, or Firm* — Canon U.S.A., Inc. IP Division

(57) ABSTRACT

According to an aspect of the present disclosure, a liquid discharge head substrate includes a substrate having a parallelogram shape, a plurality of liquid discharge elements disposed on the substrate, a plurality of power supply terminals disposed along a first side of the substrate, and a first wiring, having a lattice shape, connected to the plurality of power supply terminals. On the substrate, the first side and a third side form an obtuse angle, and the first side and a fourth side form an acute angle. In the plurality of power supply terminals, the number of power supply terminals at positions closer to the third side than to the fourth side is larger than the number of power supply terminals at positions closer to the fourth side than to the third side.

30 Claims, 13 Drawing Sheets

LIQUID DISCHARGE HEAD SUBSTRATE, LIQUID DISCHARGE HEAD, AND RECORDING APPARATUS

BACKGROUND OF THE INVENTION

Field of the Invention

The present disclosure relates to a liquid discharge head semiconductor substrate, a liquid discharge head, and a recording apparatus.

Description of the Related Art

On a liquid discharge head substrate on which a power supply line and a grounding line are branched and arranged for a plurality of liquid discharge elements, the parasitic resistance values of these lines for each liquid discharge element are varied. It is known that due to this fact, an unequal degree of voltage drop occurs in each liquid discharge element. Japanese Patent Application Laid-Open No. 2015-96318 discusses a design in each liquid discharge element for equalizing the sum of the parasitic resistance values of the power supply line and the sum of the parasitic resistance values of the grounding line to reduce the difference in degrees of voltage drop due to the parasitic resistance values of the power supply line and grounding line.

SUMMARY OF THE INVENTION

According to an aspect of the present disclosure, a liquid discharge head substrate includes a substrate having at least a first side and a second side extending along a first direction, and a third side and a fourth side extending along a second direction intersecting with the first direction, a plurality of liquid discharge elements disposed on the substrate, a plurality of power supply terminals disposed along the first side of the substrate, and a first wiring, having a lattice shape, connected to the plurality of power supply terminals, wherein, on the substrate, the first and the third sides form an obtuse angle, and the first and the fourth sides form an acute angle, and wherein, in the plurality of power supply terminals, the number of power supply terminals at positions closer to the third side than to the fourth side is larger than the number of power supply terminals at positions closer to the fourth side than to the third side.

According to another aspect of the present disclosure, a liquid discharge head substrate includes a substrate having at least a first side and a second side extending along a first direction, and a third side and a fourth side extending along a second direction intersecting with the first direction, a plurality of liquid discharge elements disposed on the substrate, a plurality of power supply terminals disposed along the first side of the substrate, and a first wiring, having a lattice shape, connected to n power supply terminals of the plurality of power supply terminals, n being a natural number equal to or larger than 1, wherein the first wiring includes a plurality of connecting portions each of which is connected to a different one of the plurality of liquid discharge elements, wherein the substrate includes a first region of which outer edges include a perpendicular line drawn from an intersection between a straight line including the first side and a straight line including the third side to a straight line including the second side, and the third side, and a second region of which outer edges include the perpendicular line and the fourth side, wherein at least one of the plurality of connecting portions is disposed in the first region, wherein, in the first direction, a position centroid of the n power supply lines has a position coordinate Cm obtained by dividing a sum of position coordinates of the n power supply terminals by n, and wherein the position centroid having the position coordinate Cm is disposed at a position closer to the third side than to the fourth side.

According to yet another aspect of the present disclosure, a liquid discharge head substrate includes a substrate having at least a first side and a second side extending along a first direction, and a third side and a fourth side extending along a second direction intersecting with the first direction, a plurality of liquid discharge elements disposed on the substrate, a plurality of power supply terminals disposed along the first side of the substrate, and a first wiring, having a lattice shape, connected to n power supply terminals of the plurality of power supply terminals, n being a natural number equal to or larger than 1, wherein the first wiring includes a plurality of connecting portions each of which is connected to a different one of the plurality of liquid discharge elements, wherein the substrate includes a first region of which outer edges include a perpendicular line drawn from an intersection between a straight line including the first side and a straight line including the third side to a straight line including the second side, and the third side, and a second region of which outer edges include the perpendicular line and the fourth side, wherein at least one of the plurality of connecting portions is disposed in the first region, and wherein a position coordinate Cc of a connection centroid of the n power supply terminals is represented by the following formula:

$$Cc = \frac{\sum_{i=1}^{n} NiCi}{\sum_{i=1}^{n} Ni}, \tag{2}$$

where Ni is the number of external wiring lines connected to an i-th power supply terminal of the n power supply terminals, i being a natural number from 1 to n inclusive, and Ci is a position coordinate of the i-th power supply terminal, and wherein the connection centroid, of the n power supply terminals, having the position coordinate Cc is disposed at a position closer to the third side than to the fourth side.

Further features of the present disclosure will become apparent from the following description of exemplary embodiments with reference to the attached drawings.

DESCRIPTION OF THE EMBODIMENTS

Figure 1:
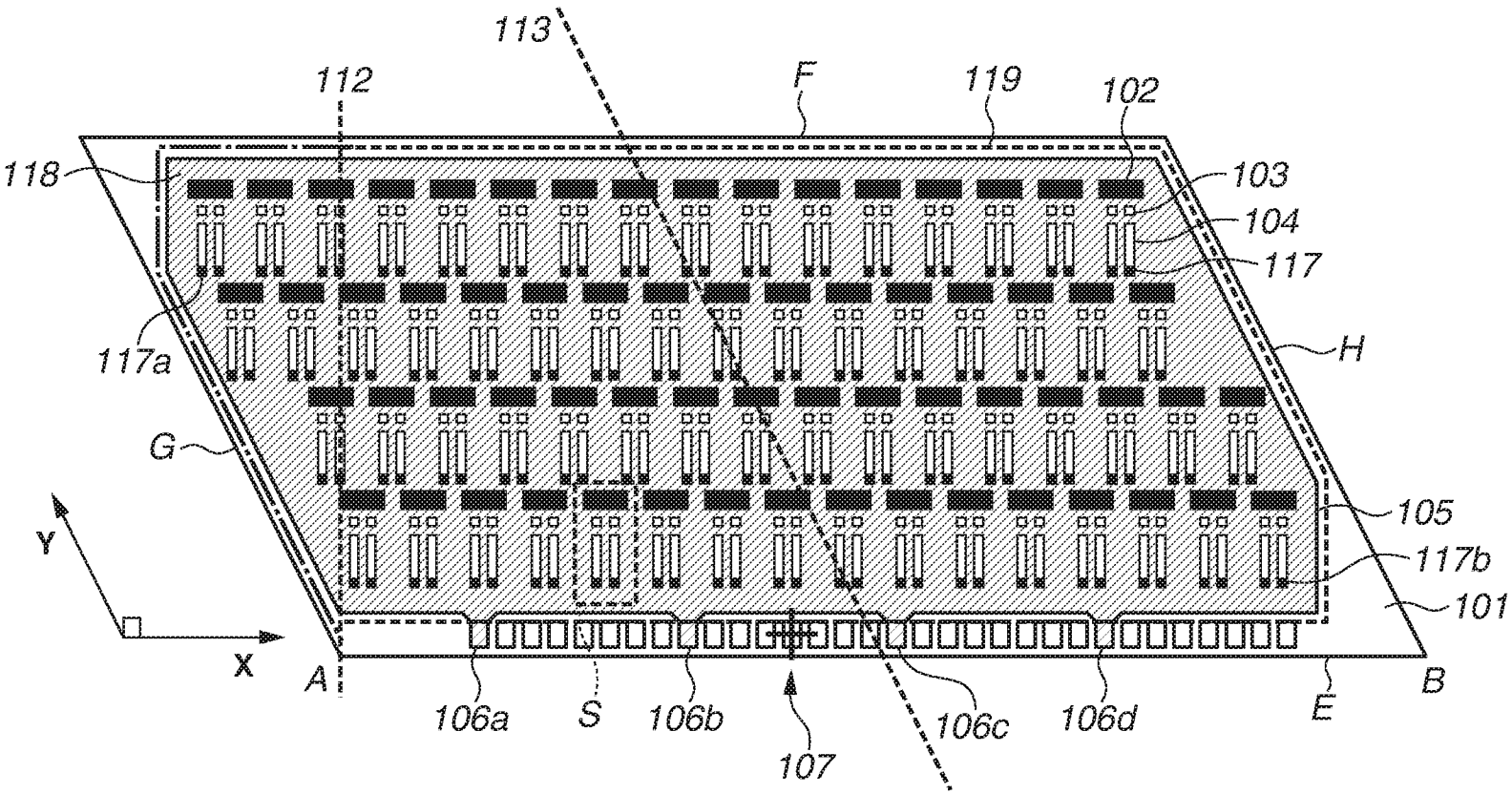
FIG. 1 is a top view illustrating a liquid discharge head substrate according to a first exemplary embodiment.

The present inventors found out that resistance values are varied among liquid discharge elements also in a liquid discharge head substrate having wiring in a lattice shape. Japanese Patent Application Laid-Open No. 2015-96318 does not consider the relationship between the unevenness in the resistance value and the arrangement of power supply terminals.

A liquid discharge head substrate, a liquid discharge head having the liquid discharge head substrate, and a recording apparatus according to exemplary embodiments will be described below with reference to the accompanying drawings. Although preferred exemplary embodiments will be described below, the present disclosure is not limited thereto but can be modified without departing from the spirit and scope thereof.

Each drawing is intended to illustrate a structure or configuration, and the dimensions of illustrated members may differ from the dimensions of actual components. In the drawing, identical members or identical components are assigned the same reference numerals, and duplicated descriptions thereof will be omitted.

FIG. 1 is a top view illustrating a liquid discharge head substrate according to the present exemplary embodiment. According to the present exemplary embodiment, a liquid discharge head substrate 101 includes a plurality of liquid discharge elements 103, a plurality of power supply terminals 106 disposed in the X direction, and a wiring 105 in a lattice shape connected to n of the plurality of power supply terminals 106 (n is a natural number equal to or larger than 1). The liquid discharge head substrate 101 further includes a plurality of ink supply ports 102 and a plurality of drive elements 104 for driving the plurality of liquid discharge elements 103 disposed in the X direction. Each of the plurality of liquid discharge elements 103 is connected to a different one of the drive element 104.

FIG. 1 is a top view illustrating an example of the liquid discharge head substrate 101 when n=4. The liquid discharge head substrate 101 includes the plurality of ink supply ports 102, the plurality of liquid discharge elements 103, and the plurality of drive elements 104 disposed in the X direction. The liquid discharge head substrate 101 further includes the wiring 105 electrically connected to a plurality of liquid discharge elements 103, and the plurality of power supply terminals 106 for connecting the wiring 105 with the outside of the liquid discharge head substrate 101. One or a plurality of wiring lines is connected to each of the power supply terminals 106, for example, using wire bonding.

The wiring 105 has a planar shape, more specifically, a lattice shape. Four power supply terminals, which are power supply terminals 106*a* to 106*d* among the power supply terminals 106 and connected to the wiring 105, are connected to wiring lines for supplying a potential from the outside to the liquid discharge elements 103 via the power supply terminals 106*a* to 106*d*. The description that the wiring 105 has a lattice shape means that the wiring 105 has a planar shape in which a plurality of openings are provided and there are at least two current paths from one point to another.

A position centroid 107 is a position centroid of the power supply terminals 106*a* to 106*d* in the X direction. Assuming that each element in the X direction has a position coordinate C, a position coordinate Cm4 of the position centroid 107 of the power supply terminals 106*a* to 106*d* is represented by formula 1 using the centroid coordinates C1 to C4 of the power supply terminals 106*a* to 106*d*, respectively.

$$Cm4=[C1+C2+C3+C4]/4 \quad (1)$$

More specifically, the coordinate of the position centroid of n power supply terminals connected to the wiring 105 in the X direction can be obtained by dividing the sum of the position coordinates of the n power supply terminals by n (n is a natural number equal to or larger than 1). The position coordinate origin in the X direction is not particularly limited. For example, an intersection (an apex A according to the present exemplary embodiment) between the straight line including a first side E and the straight line including a third side G may be considered as the origin.

The wiring 105 includes a plurality of connecting portions 117 each of which is connected to a different one of the liquid discharge elements 103. The connecting portions 117 are the portions, in a conductive layer functioning as the wiring 105, to be connected to a conductive layer functioning as another wiring, or the portions to be connected to contact plugs or the like for connection between the wiring 105 and other wiring lines.

Figure 2:
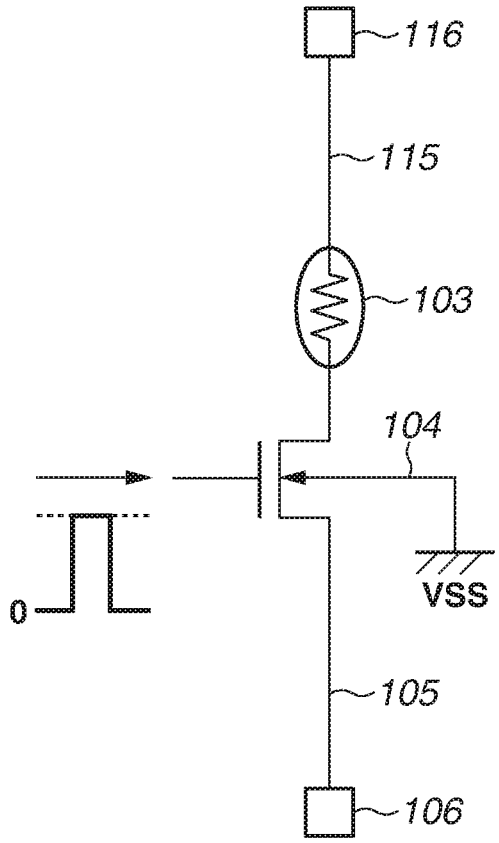
FIG. 2 is a circuit diagram illustrating a liquid discharge element, a drive element connected thereto, and wiring connections.

By taking one liquid discharge element 103 as an example, connections between the liquid discharge element 103, the drive element 104, and the wiring 105 will be described below with reference to the circuit diagram illustrated in FIG. 2. The drive element 104 includes, for example, an n-channel metal-oxide semiconductor (NMOS) transistor, and performs a switching operation when a voltage is input to the gate terminal. One end of the liquid discharge element 103 is connected to the power supply terminal 116 via the power supply line 115, and the other end of the liquid discharge element 103 is connected to the drain terminal of the drive element 104. The source terminal of the drive element 104 is connected to the power supply terminal 106 via the wiring 105. This example indicates a case where the power supply terminal 116 is a power supply terminal for supplying a high potential and is a ground terminal for supplying a ground potential. Although not illustrated, the wiring 105 and the power supply line 115 have parasitic resistances.

Figure 3:
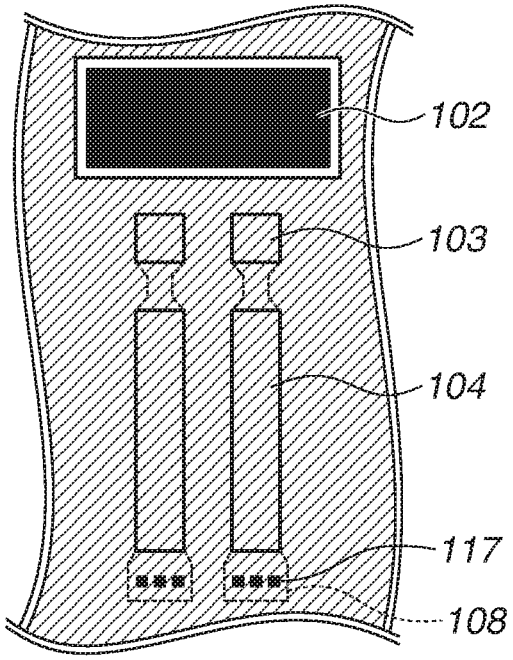
FIG. 3 is an enlarged view illustrating a region surrounded by the dotted line illustrated in FIG. 1.

FIG. 3 is an enlarged view illustrating a region S surrounded by the dotted lines illustrated in FIG. 1. The positional relation between the ink supply port 102, the liquid discharge element 103, the drive element 104, the wiring 105 will be described below with reference to FIG. 3.

Since the wiring 105 is disposed except for the ink supply port 102, the entire shape of the wiring 105 is in a lattice shape. The wiring 105 is connected to the drive element 104 via a wiring 108 drawn with dotted lines. The wiring 105 includes the connecting portions 117 to be connected to the wiring 108 in another layer, via through holes formed on an insulated film. Although, in the present exemplary embodiment, the wiring 105 is connected to the wiring 108 via three separate connecting portions, the number of connecting portions is not limited thereto, and may be one, two, or four or more. Referring to FIG. 1, the wiring 108 is omitted.

The n power supply terminals 106 are connected to n wiring lines to connect to the outside using wire bonding. For example, an external wiring is connected to each of the power supply terminals 106*a* to 106*d*.

Figure 4:
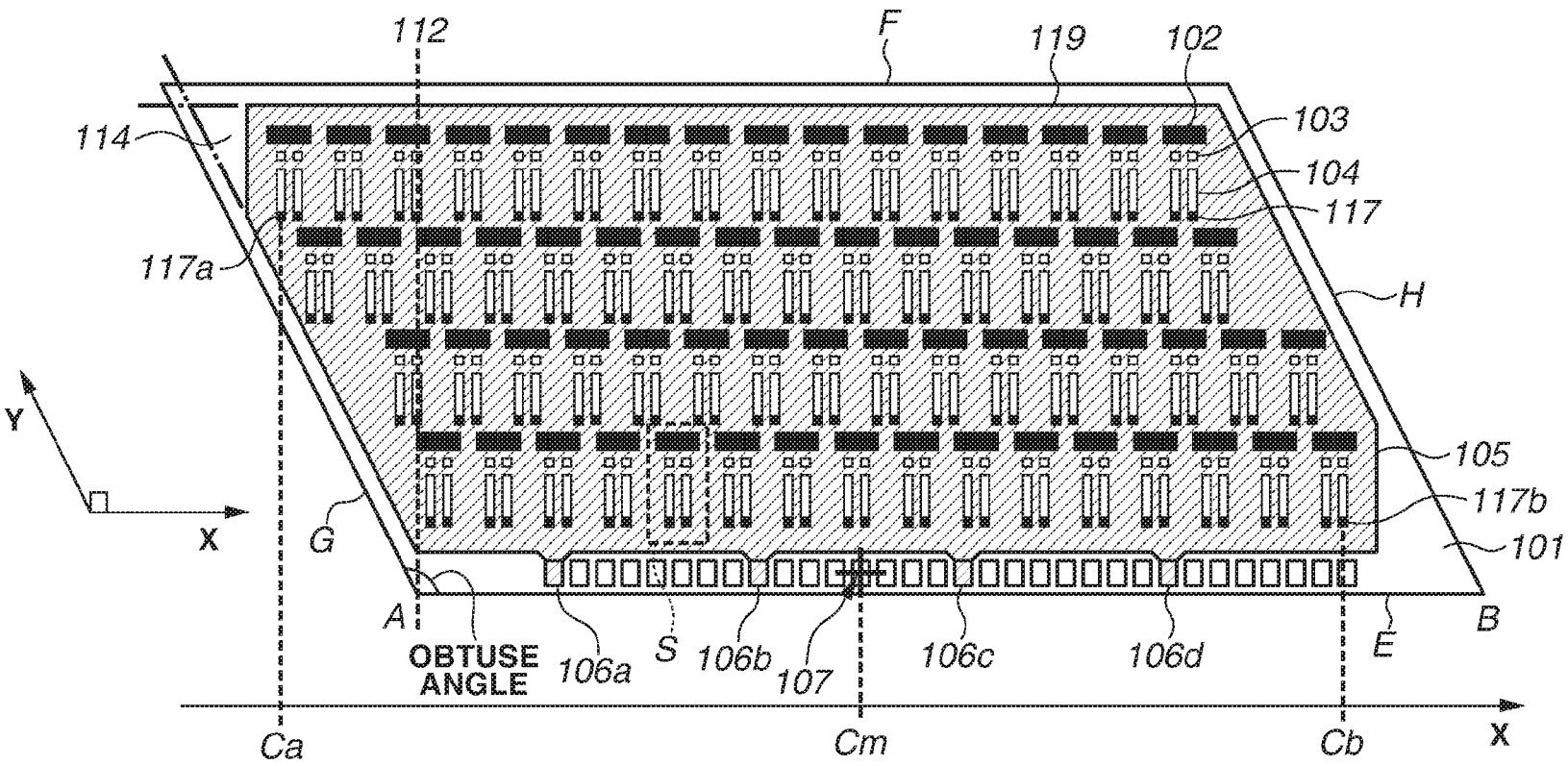
FIG. 4 is a top view illustrating another liquid discharge head substrate according to the first exemplary embodiment.

FIG. 4 illustrates the liquid discharge head substrate 101 having a similar configuration to that illustrated in FIG. 1. Referring to the liquid discharge head substrate 101 illustrated in FIG. 4, the wiring 105 has a lattice shape, and has an acute angle at a corner on the side where the power supply terminals 106 are disposed, and an obtuse angle at a corner, opposite to the corner of the acute angle, on the side where the power supply terminals 106 are disposed. Parasitic resistance values to currents from the power supply terminals 106 thus differ from position to position. It means that the positional dependence of the amount of voltage drop by the parasitic resistance to currents from the power supply terminals 106 is larger than that in a case of a liquid discharge head substrate having four right-angled corners.

In printing using a liquid discharge head, if the number of liquid discharge elements 103 which perform ink discharge at the same time is increased to improve the printing speed, a high resistance in the wiring 105 causes increase in the amount of voltage drops, which may result that the liquid discharge head does not drive. The voltage of each of the power supply terminals 106 is set according to power required for ink discharge by the liquid discharge element 103 connected at a connecting portion where the resistance value to current from the power supply terminals 106 is highest. Consequently, surplus power is supplied to the liquid discharge elements 103 connected to connecting portions where the resistance value to current from the power supply terminals 106 is low. Supplying surplus power to the liquid discharge elements 103 causes an increase in power consumption and a decrease in life of the liquid discharge elements 103. Further, setting the size of the drive circuit according to a connecting portion where the resistance value is the highest increases the size of the liquid discharge head substrate 101.

The above-described issue of the wiring 105 can be solved by lowering the resistance value at a connecting portion where the resistance value is the highest to reduce the difference between the maximum and the minimum resistance values, i.e., to reduce the difference in the resistance values in the wiring 105. Accordingly, the power supply terminals 106 are disposed in such a manner that, at a connecting portion where the resistance value is highest due to the shape of the wiring 105, the contribution of the power supply terminals 106 for supplying a potential becomes larger than that at other connecting portions (for example, a connecting portion where the resistance value is smallest).

Referring to FIG. 1, the liquid discharge head substrate 101 has at least the first side E and a second side F which extend along a first direction, and the third side G and a fourth side H which extend along a second direction intersecting with the first direction. The plurality of power supply terminals 106 is disposed on the liquid discharge head substrate 101 along the first side E. The wiring 105 which is in a lattice shape is connected to the plurality of power supply terminals 106.

On the liquid discharge head substrate 101, the first side E and the third side G make an obtuse angle, and the first side E and the fourth side H make an acute angle. In the plurality of power supply terminals 106, the number of power supply terminals 106 at positions closer to the third side G than to the fourth side H is larger than the number of power supply terminals 106 at positions closer to the fourth side H than to the third side G. The above-described configuration enables reducing the maximum resistance value of the wiring 105 to currents from the power supply terminals 106 connected to the wiring 105 at the connecting portion 117*a*. Thus, the resistance value distribution in the wiring 105 can be reduced.

Referring to FIG. 4, for example, the plurality of connecting portions 117 includes the connecting portion 117*a* where the resistance value to currents from the power supply terminals 106 is highest due to the shape of the wiring 105 and the connecting portion 117*b* which is disposed at the position farthest from the connecting portion 117*a*. The connecting portion 117*a* has a position coordinate Ca in the X direction, and the connecting portion 117*b* has a position coordinate Cb in the X direction. The position centroid 107 of the n power supply terminals 106 has a position coordinate Cm. The position coordinate Cm can be calculated by the above-described method. In this case, the difference in the resistance value between the connecting portion 117*a* and other connecting portions 117 can be reduced by disposing the n power supply terminals 106 in such a manner that the absolute value of the difference between Ca and Cm becomes smaller than the absolute value of the difference between Cb and Cm. More specifically, Ca, Cb, and Cm satisfy the following formula 2.

$$|Cm-Ca|<|Cb-Cm| \quad (2)$$

On the liquid discharge head substrate 101 according to the present exemplary embodiment, the plurality of connecting portions 117 are disposed in such a manner that a plurality of rows each including connecting portions 117 disposed along the X direction is provided, and is disposed in the Y direction intersecting with the X direction. The Y direction is parallel to one side of the liquid discharge head substrate 101. The connecting portion 117*a* is positioned in the farthest row, among the plurality of rows, from the n power supply terminals 116 in the Y direction. The connecting portion 117*a* is positioned at an end in the row. More specifically, referring to FIG. 4, the connecting portion 117*a* is the connecting portion closest to the second side F and the third side G of the liquid discharge head substrate 101, among the plurality of connecting portions 117.

The liquid discharge head substrate 101 according to the present exemplary embodiment will be described in detail below with reference to FIG. 1. The liquid discharge head substrate 101 has at least the first side E and the second side F which extend along the first direction, and the third side G and the fourth side H which extend along the second direction intersecting with the first direction. The straight line including the first side E and the straight line including the third side G make an obtuse inner angle. The obtuse angle corner and the acute angle corner on the first side E are referred to as apexes A and B, respectively. In this example, the liquid discharge head substrate 101 has the shape of a parallelogram.

The liquid discharge head substrate 101 is divided into a first region 118 and a second region 119 by a perpendicular line 112 drawn from the intersection (peak A) between the straight line including the first side E and the straight line including the third side G to the straight line including the second side F. Referring to FIG. 1, the first region 118 is a region surrounded by one-point chain lines, and the second region 119 is a region surrounded by broken lines.

More specifically, referring to FIG. 1, the outer edges of the first region 118 include the perpendicular line 112 and the third side G and are drawn with one-point chain lines, and the outer edges of the second region 119 include the perpendicular line 112 and the fourth side H and are drawn with broken lines. When the intersection between the straight line including the first side E and the straight line including the third side G is inside the liquid discharge head substrate 101, the outer edges of the first region 118 and the outer edges of the second region 119 include the intersections between the straight line including the perpendicular line 112 and the outer edges of the liquid discharge head substrate 101. A median line 113 is a straight line passing through the middle point of the first side E and the middle point of the second side F.

The plurality of liquid discharge elements 103 is disposed in the X direction to form a row of the liquid discharge elements 103. According to the present exemplary embodiment, four rows of the liquid discharge elements 103 are disposed in the Y direction on the liquid discharge head substrate 101, with the layout origin of each of the rows shifted in the X and Y directions. It means that the liquid discharge elements 103 are also disposed in the first region 118. The wiring 105 is shaped according to the arrangement of the liquid discharge elements 103 to supply a potential to the liquid discharge elements 103. Consequently, both part of the wiring 105 and some of the connecting portions 117 are disposed in the first region 118 which includes the acute angle close to the intersection between the second side F and the third side G.

The resistance values of the wiring 105 to currents from the n power supply terminals 106 increases in the first region 118 and remarkably increases in the region of the acute angle between the second side F and the third side G where the connecting portion 117*a* is disposed. The amount of voltage drop by the resistance values of the wiring 105 at the connecting portions 117 to currents from the n power supply terminals 106 increases in the first region 118, and remarkably increases in the region of the acute angle between the second side F and the third side G where the connecting portion 117*a* is disposed. This means therefore that the resistance value distribution in the wiring 105 can be reduced by reducing the maximum resistance value of the wiring 105, which is the resistance value at the connecting portion 117*a* to currents from the n power supply terminals 106. More specifically, the distribution of the amount of voltage drop in the wiring 105 can be reduced.

Thus, the n power supply terminals 106 are disposed in a manner such that the position centroid 107 of the n power supply terminals 106 is positioned closer to the third side G than to the fourth side H in the X direction. Such a configuration can reduce maximum resistance value of the wiring 105 and also reduce the resistance value distribution in the wiring 105.

For example, out of the n power supply terminals 106, the number of power supply terminals 106 disposed at positions closer to the third side G than to the fourth side H is made larger than the number of power supply terminals 106 disposed at positions closer to the fourth side H than to the third side G. Thus, the position centroid 107 of the n power supply terminals 106 is positioned closer to the third side G than to the fourth side H.

On the liquid discharge head substrate 101 illustrated in FIG. 4, two liquid discharge elements 103 are disposed along the ink supply ports 102 and each connected to a different one of the drive elements 104. Other connection relations (not illustrated) are as described above with reference to FIG. 2. The ink supply ports 102 are distributed in four rows each of which is disposed along with a different one of the rows of the liquid discharge elements 103. To leave the ink supply ports 102 which are two-dimensionally disposed on the liquid discharge head substrate 101, the wiring 105 has a lattice shape. In other words, the wiring 105 is provided with openings for the ink supply ports 102. The wiring 105 having a planar shape in this way can be configured by using one of metal layers in a semiconductor device formed in semiconductor manufacturing processes.

Figure 5:
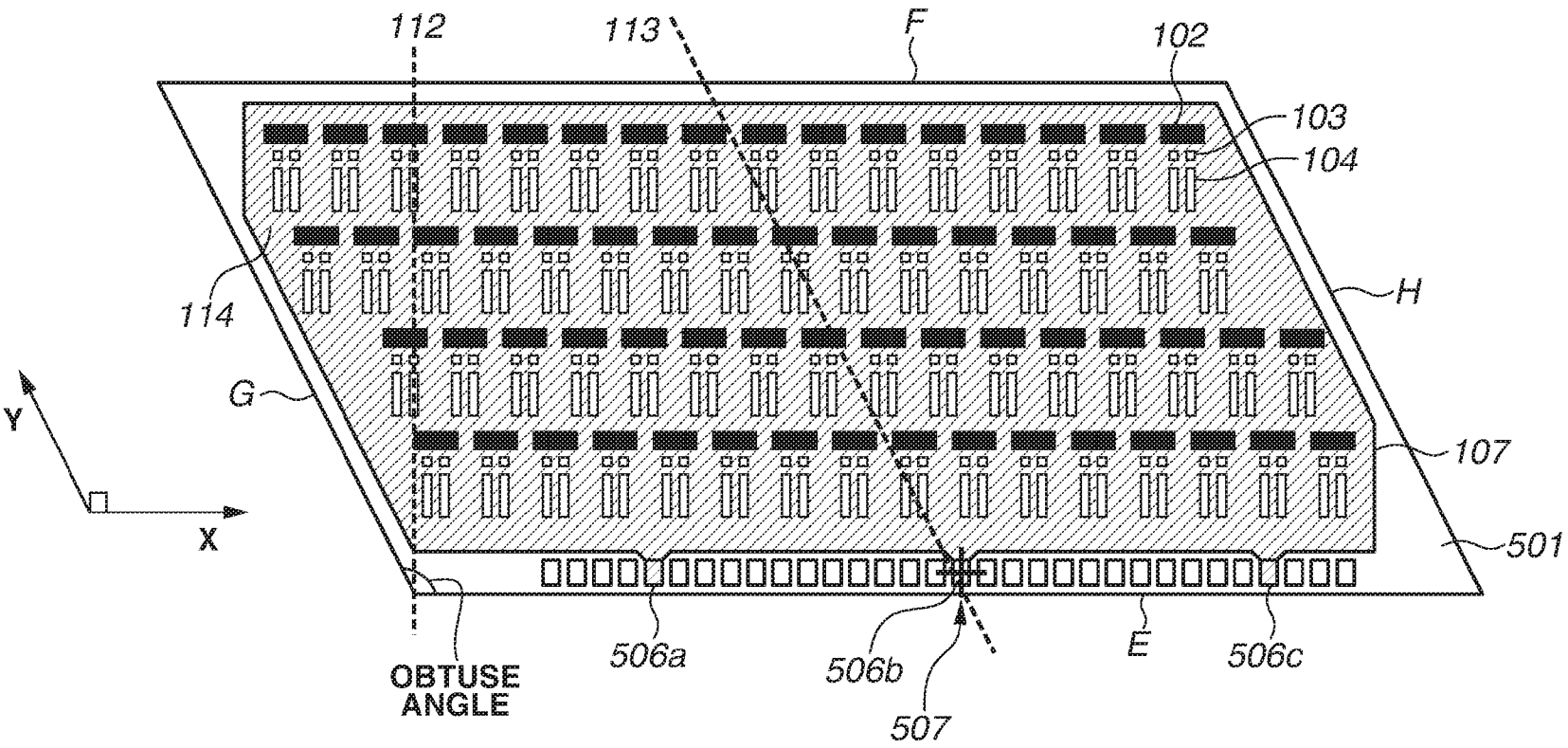
FIG. 5 is a top view illustrating a liquid discharge head substrate according to a comparative example.

Effects according to the present exemplary embodiment will be described below with reference to a comparative example. FIG. 5 is a top view illustrating a liquid discharge head substrate 501 as a comparative example. The liquid discharge head substrate 501 has the same number of liquid discharge elements 103 and the same shape of the wiring 105 as those of the liquid discharge head substrate 101 according to the present exemplary embodiment. Power supply terminals 506*a* to 506*c* are disposed along the first side E. The liquid discharge head substrate 501 according to the comparative example differs from the liquid discharge head substrate 101 according to the present exemplary embodiment in that the power supply terminals 506*a* to 506*c* are disposed in such a manner that the position of a position centroid 507 is slightly shifted toward the fourth side H from the center of the liquid discharge head substrate 501 in the X direction. In the liquid discharge head substrate 501, four rows of the liquid discharge elements 103 are disposed in the Y direction. Each row includes 32 liquid discharge elements 103 disposed in the X direction.

Figure 6:
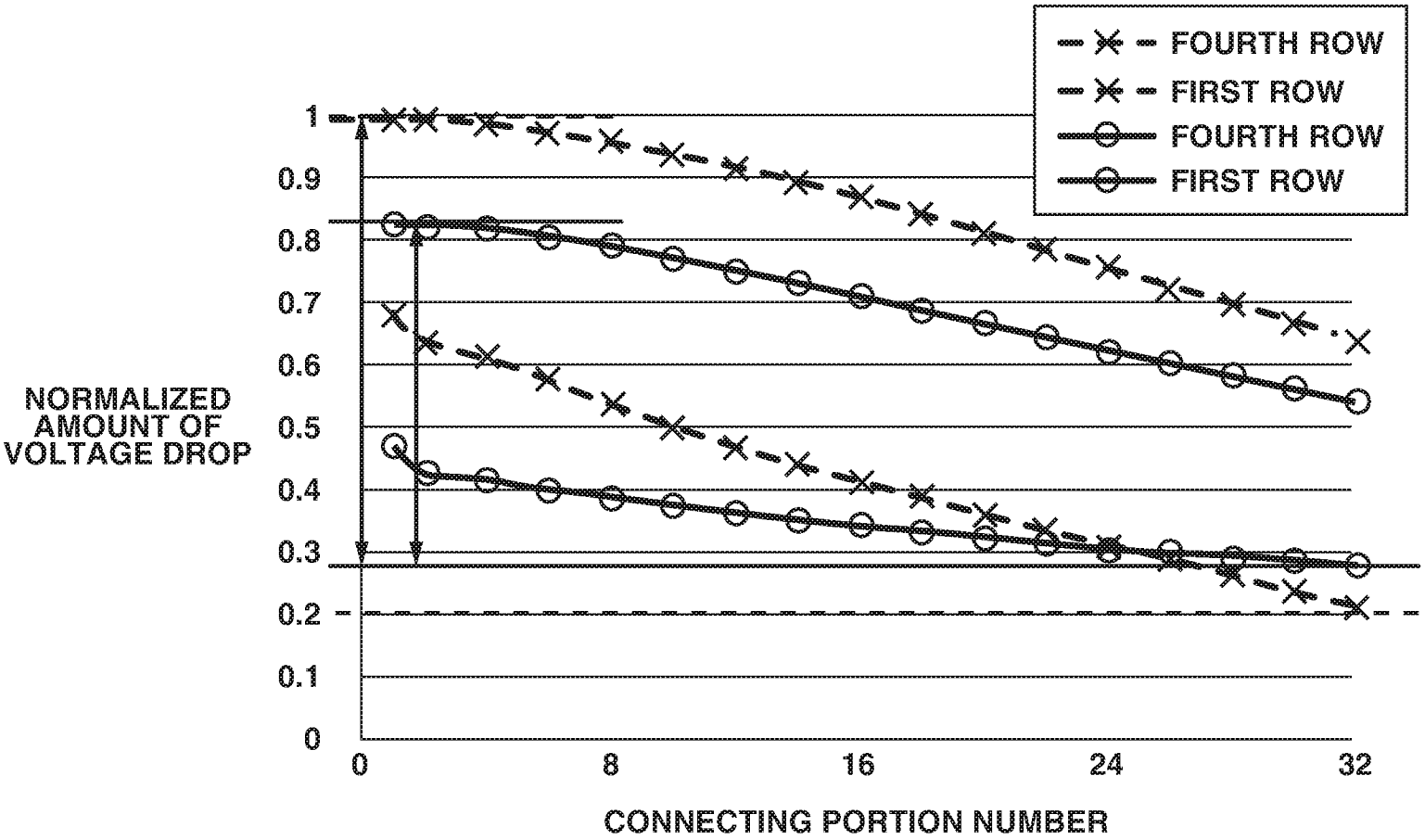
FIG. 6 is a graph illustrating a relation between a position and a voltage drop of a plurality of liquid discharge elements on the liquid discharge head substrates according to the comparative example and the first exemplary embodiment.

FIG. 6 illustrate a result of a simulation on the comparative example illustrated in FIG. 5 and the liquid discharge head substrate 101 according to the present exemplary embodiment illustrated in FIG. 1. The result is obtained by a simulate the relation between the positions of the connecting portions 117 at different positions in the X and Y directions and the amount of voltage drop in the liquid discharge element 103 connected to each connecting portion 117. The simulation was performed under a condition that a current is sent to all of the liquid discharge elements 103. The vertical axis denotes the amount of voltage drop in the liquid discharge elements 103 normalized by assuming that the amount of voltage drop in the liquid discharge element 103 having the largest amount of voltage drop is 1. The horizontal axis denotes the number of the connecting portion 117 counted from the third side G. More specifically, the smaller the number of the connecting portion 117 on the horizontal axis, the closer the connecting portion 117 is to the third side G.

FIG. 6 illustrates a result of the simulation on the liquid discharge elements 103 in the first row closest to the first side E and the liquid discharge elements 103 in the fourth row closest to the second side F. The amount of voltage drop in the liquid discharge elements 103 of the liquid discharge head substrate 501 according to the comparative example is represented by "O", and the amount of voltage drop in the liquid discharge elements 103 of the liquid discharge head substrate 101 according to the present exemplary embodiment is represented by "X".

First of all, analysis is made for the difference in amount of voltage drop in the liquid discharge element 103 by the difference in position in the X and Y directions on the liquid discharge head substrate 101. The analysis is made by taking the liquid discharge head substrate 101 according to the present exemplary embodiment as an example since the liquid discharge head substrate 501 according to the comparative example and the liquid discharge head substrate 101 according to the present exemplary embodiment have similar tendencies.

Referring to FIG. 6, it can be understood that the liquid discharge element 103 with the smallest number in the fourth row provides the largest amount of voltage drop, i.e., the liquid discharge element 103 having the largest amount of voltage drop is in the first region 118. Referring to FIG. 6, the liquid discharge elements 103 disposed in a row more distant from the power supply terminals 106 have a larger amount of voltage drop. Also, in the row more distant from the power supply terminals 106, the liquid discharge element 103 disposed at a position with the smaller number has a larger amount of voltage drop. In the present simulation, the liquid discharge elements 103 differ from each other only in the resistance value of the wiring 105 connected to the liquid discharge elements 103. The result is that the connecting portions 117 of the wiring 105 connected to the liquid discharge elements 103 having a large amount of voltage drop have high resistance values.

Although FIG. 6 illustrates only the liquid discharge elements 103 in the first and fourth rows, the amount of voltage drop in the liquid discharge elements 103 in the second and third rows have similar tendencies to those of the liquid discharge elements 103 in the first and fourth rows. As described above, there is a tendency that the liquid discharge elements 103 disposed in the second row have a larger amount of voltage drop than those of the liquid discharge elements 103 disposed in the first row, the liquid discharge elements 103 disposed in the third row have a larger amount of voltage drop than those of the liquid discharge elements 103 disposed in the second row, and the liquid discharge elements 103 disposed in the fourth row have a larger amount of voltage drop than those of the liquid discharge elements 103 disposed in the third row. More specifically, the liquid discharge head substrate 101 has a tendency that the connecting portions 117 in a region closer to the third side G have higher resistance values, and a tendency that the connecting portions 117 included in a row more distant from the power supply terminals 106 have higher resistance values.

Accordingly, it can be understood that the connecting portion 117 having the highest resistance value to currents from the power supply terminals 106*a* to 106*d* is in the first region 118. Likewise, the connecting portions 117 disposed in a row more distant from the power supply terminals 106 have larger resistance values to currents from the power supply terminals 106*a* to 106*d* and, in the row more distant from the power supply terminals 106, the connecting portion 117 disposed at a position with the smaller number has a larger resistance value to currents from the power supply terminals 106*a* to 106*d*.

As described above, each row of the connecting portions 117 includes the connecting portion 117 having the largest resistance value. In a region closer to the third side G than to the fourth side H, the connecting portion 117 at a position closer to the third side G has a larger parasitic resistance value in each row of the connecting portions 117. The reasons for this are as follows. Firstly, the connecting portions 117 closer to the third side G than to the power supply terminal 106*a* are distant from the power supply terminals 106*b* to 106*d* (other than the closest power supply terminal 106*a*) compared to other connecting portions 117. Secondly, the wiring 105 has a plurality of openings so that the wiring 105 has a lattice shape, and has acute and obtuse angles, and therefore current paths of currents from the power supply terminals 106 are physically restricted.

On the other hand, on the liquid discharge head substrate 101 according to the present exemplary embodiment, the position centroid 107 of the n power supply terminals 106 connected to the wiring 105 is arranged to be positioned closer to the third side G than to the fourth side H, as described above. Thus, among a plurality of connecting portions 117 of the wiring 105, the distance in the X direction from the connecting portion 117*a*, having the highest resistance value to currents from the n power supply terminals 106, to the position centroid 107 becomes shorter than the distance in the X direction from the connecting portion 117*b* farthest from the connecting portion 117*a* to the position centroid 107. This results in lowering the resistance value of the connecting portion 117*a* having the highest resistance value, and further results in reducing the resistance values and also the difference in the amounts of voltage drop in the power supply line 115.

Effects of the liquid discharge head substrate 101 according to the present exemplary embodiment in comparison with the liquid discharge head substrate 501 according to the comparative example illustrated in FIG. 5 will be described below with reference to FIG. 6.

Referring to FIG. 6, according to the present exemplary embodiment, the liquid discharge element 103 closest to the second side F and the third side G, among the liquid discharge elements 103 in the first region 118, has a remarkably small amount of voltage drop compared to the liquid discharge element 103 in comparative example. More specifically, it can be understood that, by changing the configuration from the configuration according to the comparative example to the configuration according to the present exemplary embodiment, among the connecting portions 117 having the high resistance values in the first region 118, especially the connecting portion 117*a* closest to the second side F and the third side G has a decrease in the resistance value.

Referring to FIG. 6, the difference between the maximum and the minimum amounts of voltage drop in the liquid discharge elements 103 according to the present exemplary embodiment is remarkably smaller than the difference between the maximum and the minimum amounts of voltage drop in the liquid discharge elements 103 according to the comparative example. In the example illustrated in FIG. 6, by changing the positions of the power supply terminals 106 connected to the wiring 105 in the X direction from the positions according to the comparative example to the positions according to the present exemplary embodiment, the difference between the maximum and the minimum amounts of voltage drop in the liquid discharge elements 103 can be reduced by about 30%.

More specifically, by the configuration according to the present exemplary embodiment, it becomes possible to reduce the difference, due to the shape of the wiring 105, in the resistance values to currents from the n power supply terminals 106 between positions of the connecting portions 117, and which results in reducing the difference in resistance values among the plurality of connecting portions 117. This means that the difference in the amounts of voltage drop among the plurality of connecting portions 117 can be reduced.

According to the configuration of the present exemplary embodiment, it becomes possible to design the drive element 104 in small size and to downsize the liquid discharge head substrate 101. Also, according to the configuration of the present exemplary embodiment, the maximum resistance value of the connecting portions 117 can be reduced, and a large number of liquid discharge elements 103 can be therefore simultaneously driven. Consequently, the printing speed can be improved. Further, according to the configuration of the present exemplary embodiment, it becomes possible to reduce surplus power applied to the liquid discharge elements 103 coupled with the connecting portions 117 having low resistance values, and which increases the life.

Although the present exemplary embodiment has been described above using an example case where the wiring 105 having a lattice shape is supplied with the ground potential, the liquid discharge head substrate 101 described in the present specification is not limited thereto. The arrangement of the power supply lines described in the present specification is effective when at least one power supply line has a lattice shape. The maximum resistance value can be reduced in wiring which has a lattice shape and has the difference in the resistance values to currents from the power supply lines.

Figure 7:
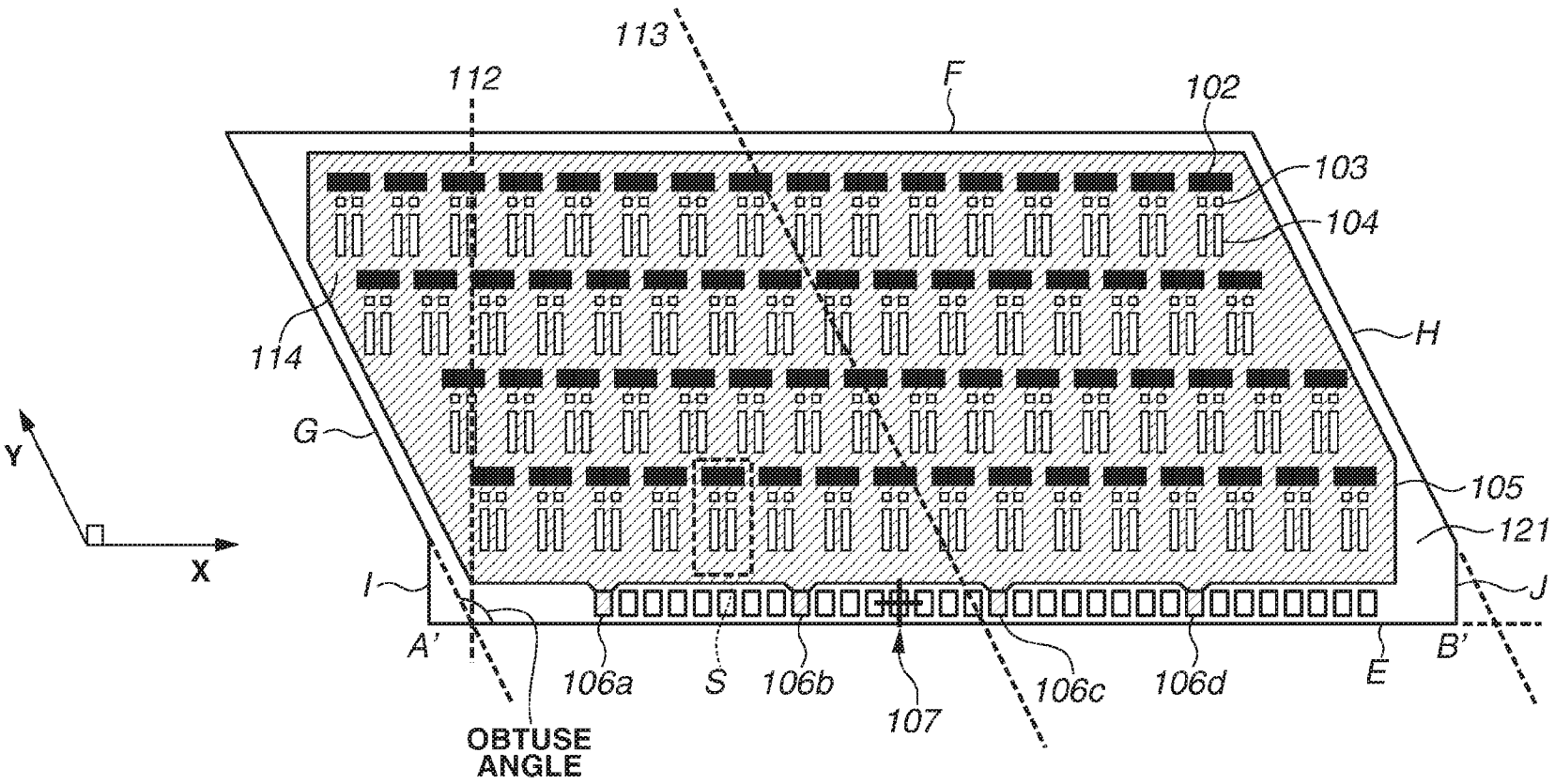
FIG. 7 is a top view illustrating a liquid discharge head substrate different in substrate shape from the liquid discharge head substrate illustrated in FIG. 1.

A liquid discharge head substrate 121 different in the shape of the liquid discharge head substrate 101 from the liquid discharge head substrate 101 illustrated in FIG. 1 will be described below with reference to the top view illustrated in FIG. 7. The liquid discharge head substrate 121 differs from the liquid discharge head substrate 101 in that there are provided a fifth side I perpendicularly intersecting with the first side E and intersecting with the third side G, and a sixth side J perpendicularly intersecting with the first side E and intersecting with the fourth side H. In this shape, the straight line including the third side G and the second side F of the liquid discharge head substrate 121 make an acute angle, and the first region 118 includes the acute angle. It means that, among the plurality of connecting portions 117, the connecting portion 117*a* having the highest resistance value to currents from the n power supply terminals 106 is disposed in the first region 118.

Also in this case, the difference in resistance values and the difference in amounts of voltage drop between the connecting portion 117*a* and other connecting portions 117 can be reduced by disposing the n power supply terminals 106 in such a manner that the absolute value of the difference between Ca and Cm becomes smaller than the absolute value of the difference between Cb and Cm. Further, the n power supply terminals 106 are disposed in such a manner such that the position centroid 107 of the n power supply terminals 106 is positioned closer to the third side G than to the fourth side H in the X direction. This configuration enables the maximum resistance value of the wiring 105 to be reduced, and the distributions of the resistance values and the amounts of voltage drop in the wiring 105 can be thus reduced.

Although the present exemplary embodiment has been described above using an example case where the power supply terminals 106 are supplied with the ground potential and the position centroid 107 of the power supply terminals 106 is positioned closer to the third side G than to the fourth side H, the liquid discharge head substrate is not limited thereto. The effects of the present exemplary embodiment can also be obtained when the power supply terminals 116 are connected to wiring having a lattice shape, and the position centroid of the power supply terminals 116 is positioned closer to the third side G than to the fourth side H. The effects are maximized when both the position centroid 107 of the power supply terminals 106 and the position centroid of the power supply terminals 116 are positioned closer to the third side G than to the fourth side H.

Another example will be described below with reference to the top view of a liquid discharge head substrate 301 illustrated in FIG. 8. In the example, the number of power supply terminals 106 sharing currents from the outside is made larger than that in the example illustrated in FIG. 1 so that the position of the position centroid 107 according to the present exemplary embodiment satisfies the formula 2. According to the present exemplary embodiment, the power supply terminals 106 are disposed in the X direction along the first side E, and the wiring 105 is shaped along the liquid discharge head substrate 301 having the shape of a parallelogram. The position centroid 107 of the power supply terminals 106 can be brought close to the connecting portions having a high resistance value by selectively disposing the power supply terminals 106 to be connected to external wiring lines on the side of the obtuse angle corner A of the center of the first side E.

Consequently, on the liquid discharge head substrate 301, the four power supply terminals 106 to be connected to external wiring lines are intensively disposed toward the side of the third side G of the median line 113.

A perpendicular line 302 will be defined below for the sake of description. The perpendicular line 302, a straight line perpendicular to the first direction, passes through the middle point of the first side E. On the liquid discharge head substrate 301 having the shape of a parallelogram, the number of liquid discharge elements 103 disposed on the side of the third side G from the perpendicular line 302 is larger than the number of liquid discharge elements 103 disposed on the side of the fourth side H from the perpendicular line 302. When a large number of the liquid discharge elements 103 are simultaneously driven, currents will concentrate on the power supply terminals 106 which are disposed on the side of the third side G from the perpendicular line 302 and connected with external wiring lines.

Figure 8:
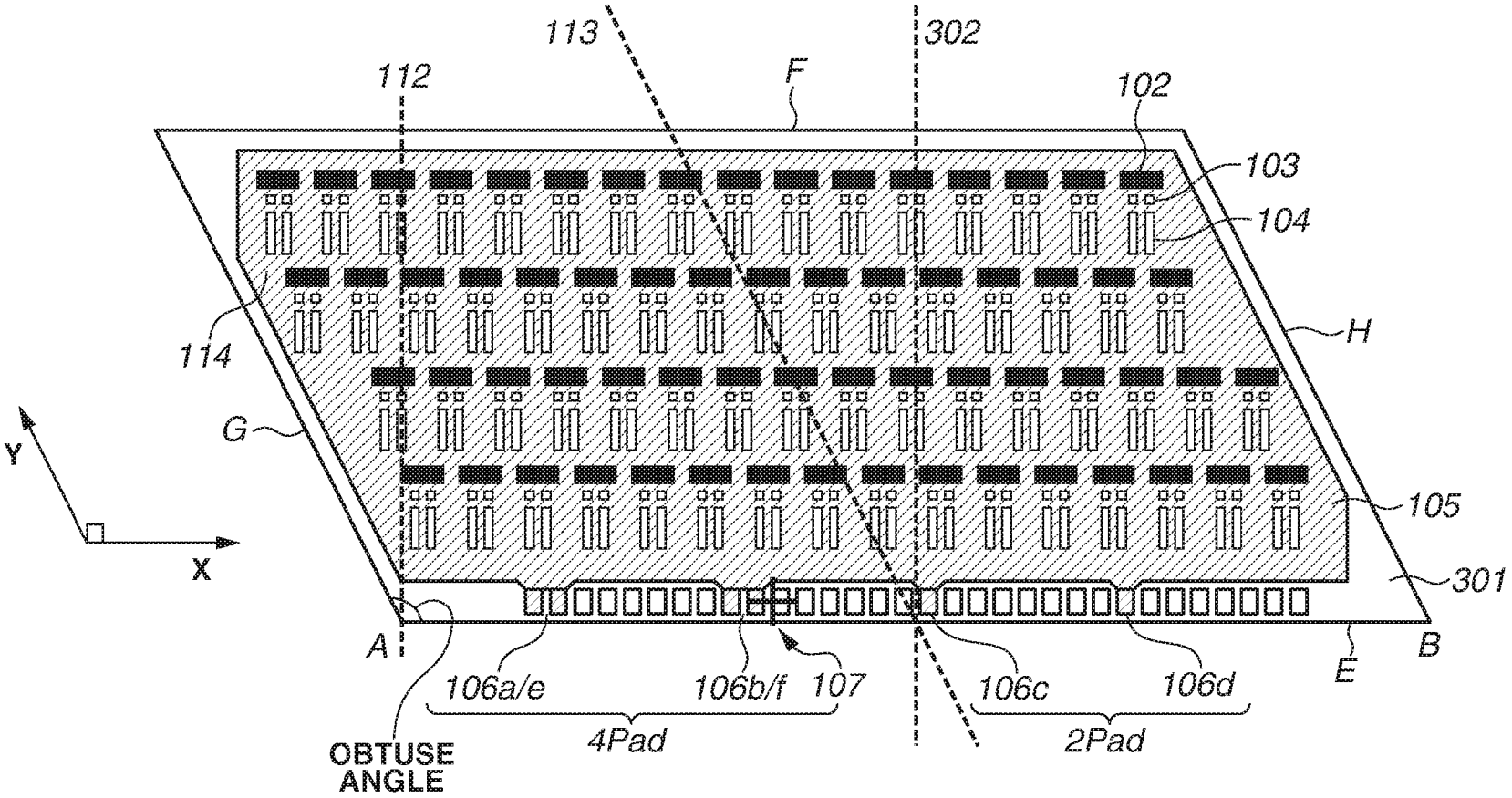
FIG. 8 is a top view illustrating an example of a liquid discharge head substrate having a larger number of power supply terminals to be connected with external wiring lines than the number thereof the liquid discharge head substrate illustrated in FIG. 1.

By disposing the power supply terminals 106 connected to external wiring lines as illustrated in FIG. 8, currents flowing in the region on the side of the third side G from the perpendicular line 302 can be provided from a larger number of power supply terminals 106 than the number of the power supply terminals 106 in the case illustrated in FIG. 1. Accordingly, when a number of liquid discharge elements 103 are simultaneously driven, the rise of the ground potential through current concentration occurring on the side of the third side G from the perpendicular line 302 can be reduced.

The present exemplary embodiment will be described below using an example of a case where the number of power supply terminals 106 disposed on the side of the third side G from the perpendicular line 302 is increased, on the premise that bonding is performed from the outside on each of the power supply terminals 106. This method can be implemented not only by changing the number of power supply terminals 106 to be connected to external wiring lines but also by increasing the number of bondings on external wiring lines to be connected to each of the power supply terminals 106.

Figure 9:
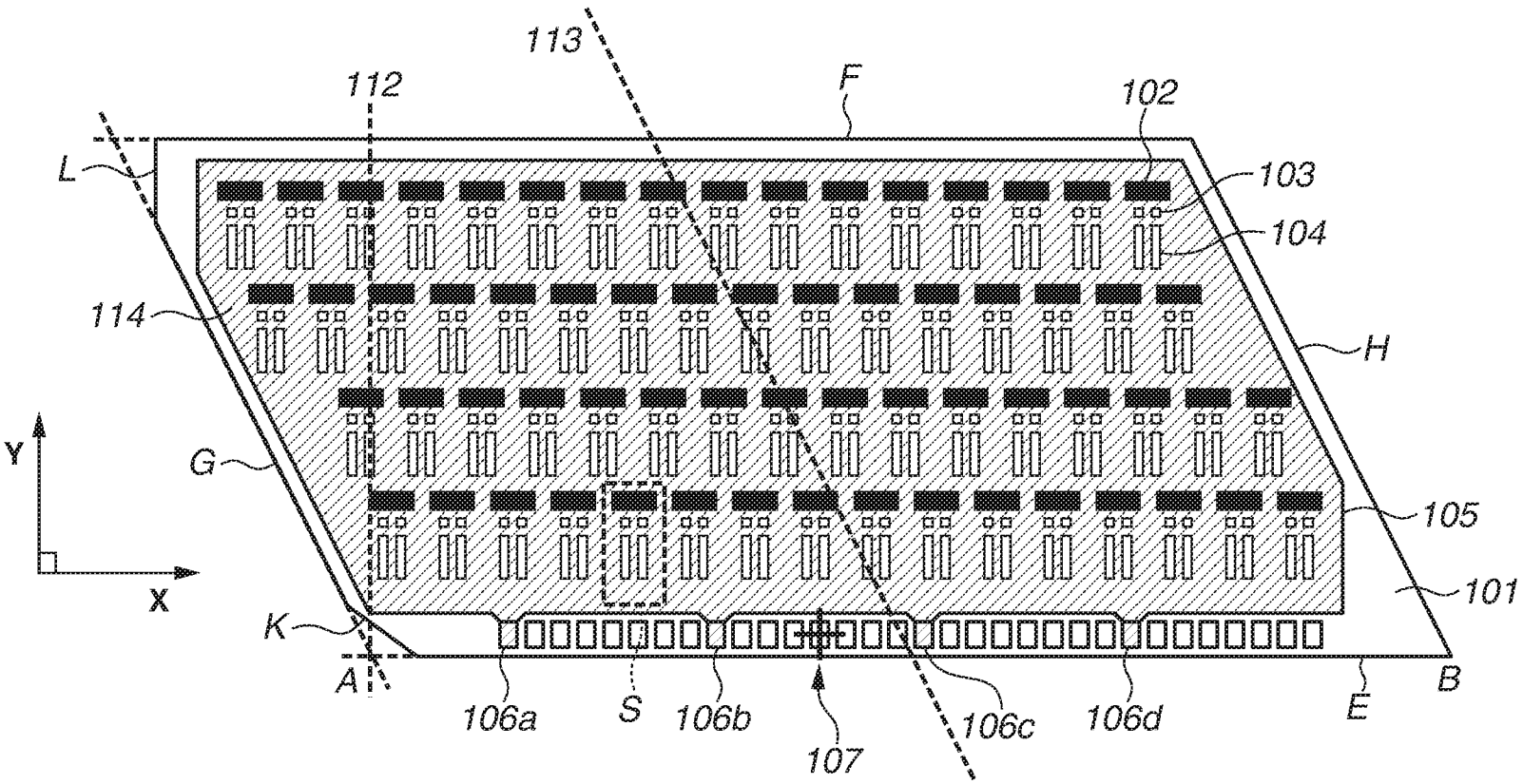
FIG. 9 is a top view illustrating yet another liquid discharge head substrate according to the first exemplary embodiment.

The substrate may partly differ in shape from the liquid discharge head substrate 101 illustrated in FIG. 1. For example, as illustrated in FIG. 9, the liquid discharge head substrate 101 can be shaped in such a way that the corner between the first side E and the third side G and the corner between the second side F and the third side G are removed. Also in this case, similar effects can be acquired by disposing the power supply terminals 106 to be connected to external wiring lines in such a manner that the position centroid 107 satisfies the above-described condition. For example, the intersection A between the straight line including the first side E and the straight line including the third side G is at outside of the liquid discharge head substrate 101, as illustrated in FIG. 9. Even in this case, similar to FIG. 1, the first region 118 and the second region 119 on the liquid discharge head substrate 101 can be defined by the perpendicular line 112. Other portions are similar to those illustrated in FIG. 1 and duplicated descriptions thereof will be omitted.

Figure 10:
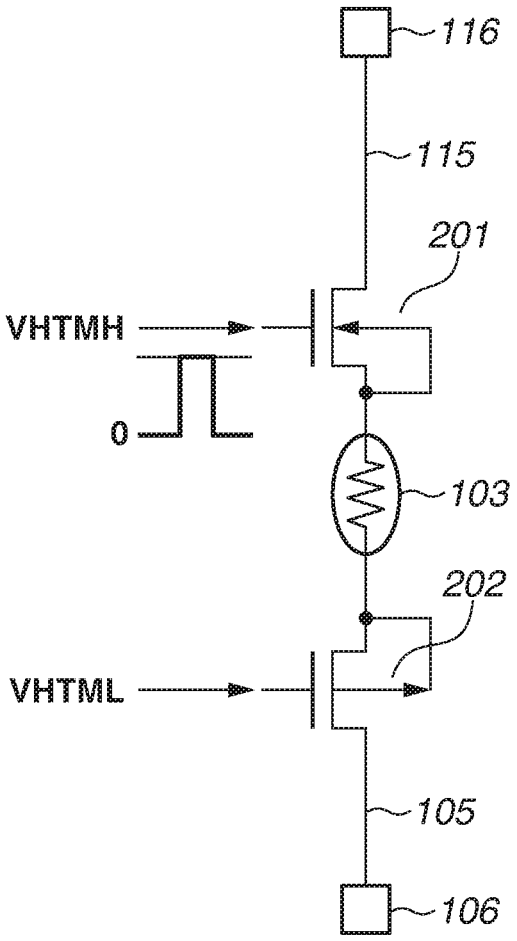
FIG. 10 illustrates a circuit diagram of a part of a liquid discharge head substrate configured as a voltage compensated drive circuit.

An example of a liquid discharge head substrate having a drive circuit different from the drive circuit of the liquid discharge element 103 according to the first exemplary embodiment will be described below. Although, in the first exemplary embodiment, the liquid discharge element 103 is driven by a drive element performing a switching operation, the present exemplary embodiment is not limited thereto. For example, the liquid discharge element 103 may be driven by a circuit for performing voltage compensation as illustrated in FIG. 10. A configuration of a voltage compensated drive circuit will be described below with reference to FIG. 10. In this example, the power supply terminal 106 is supplied with the ground potential through an external wiring line, and the power supply terminal 116 is supplied with a high voltage such as 32V. One end of the liquid discharge element 103 is connected to the wiring 105 via the drive element 202, and the other end thereof is connected to the power supply line 115 via the drive element 201.

More specifically, one end of the liquid discharge element 103 is connected to the source terminal of an NMOS transistor (drive element 201) which performs a source follower operation. The other end of the liquid discharge element 103 is connected to the source terminal of a p-channel metal-oxide semiconductor (PMOS) transistor (drive element 202) which performs a source follower operation. The drain terminal of the NMOS transistor as the drive element 201 is connected to the power supply terminal 116 via the power supply line 115.

The drain terminal of the PMOS transistor as the drive element 202 is connected to the power supply terminal 106 via the wiring 105. The above-described configuration enables controlling the voltages of both terminals of the liquid discharge element 103 by changing the gate voltage of the NMOS transistor as the drive elements 201 and the gate voltage of the PMOS transistor as the drive element 202. This form of a drive circuit is referred to as a voltage compensated drive circuit.

A drive pulse for controlling the ON and OFF state of the NMOS transistor is applied from a control circuit (not illustrated) to the gate terminal of the NMOS transistor as the drive element 201. A signal having a constant voltage VHTML is applied to the gate terminal of the PMOS transistor as the drive element 202.

In the voltage compensated drive circuit, influences of a voltage rise by the resistance of the wiring 105 and a voltage drop by the resistance of the power supply line 115 can be reduced by disposing the liquid discharge element 103 between the NMOS and the PMOS transistors which perform a source follower operation. The voltage applied to both terminals of a recording element can be brought close to a constant voltage determined by the characteristics of the MOS transistors.

However, the large resistance values of the wiring 105 and the power supply line 115 produce, for example, a large amount of voltage drop in the power supply line 115 when a number of liquid discharge elements 103 are simultaneously turned ON. When the drain terminal potential VH of the NMOS transistor is lower than a voltage $V_{limit}$ represented by the following formula 3, the voltages supplied to the drive elements 201 and 202 cannot be maintained:

$$VH<V_{limit}=V_{HTMH}-V_{th}+V_{Dsat} \quad (3),$$

where $V_{th}$ is a threshold value voltage of the NMOS transistor as the drive element 201, $V_{Dsat}$ is a saturation drain voltage, and $V_{HTMH}$ is a gate voltage.

A similar condition also applies to the wiring 105 supplied with the ground potential. According to the present exemplary embodiment, at least one of the wiring 105 and the power supply line 115 has the difference in resistance values to currents from the power supply terminals 106 due to the wiring shape. Such a liquid discharge head substrate has a voltage compensated drive circuit using the MOS transistors performing a source follower operation, and at least one of the power supply terminals 106 and 116 is disposed in such a manner that the position centroid of the power supply lines is positioned according to the first exemplary embodiment. The above-described configuration enables a voltage drop in the power supply line 115 and a voltage float (deviation from the ground potential) in the wiring 105 to be reduced. Consequently, even if a larger number of liquid discharge elements 103 are simultaneously driven, the voltage compensation characteristics can be maintained.

Figure 11:
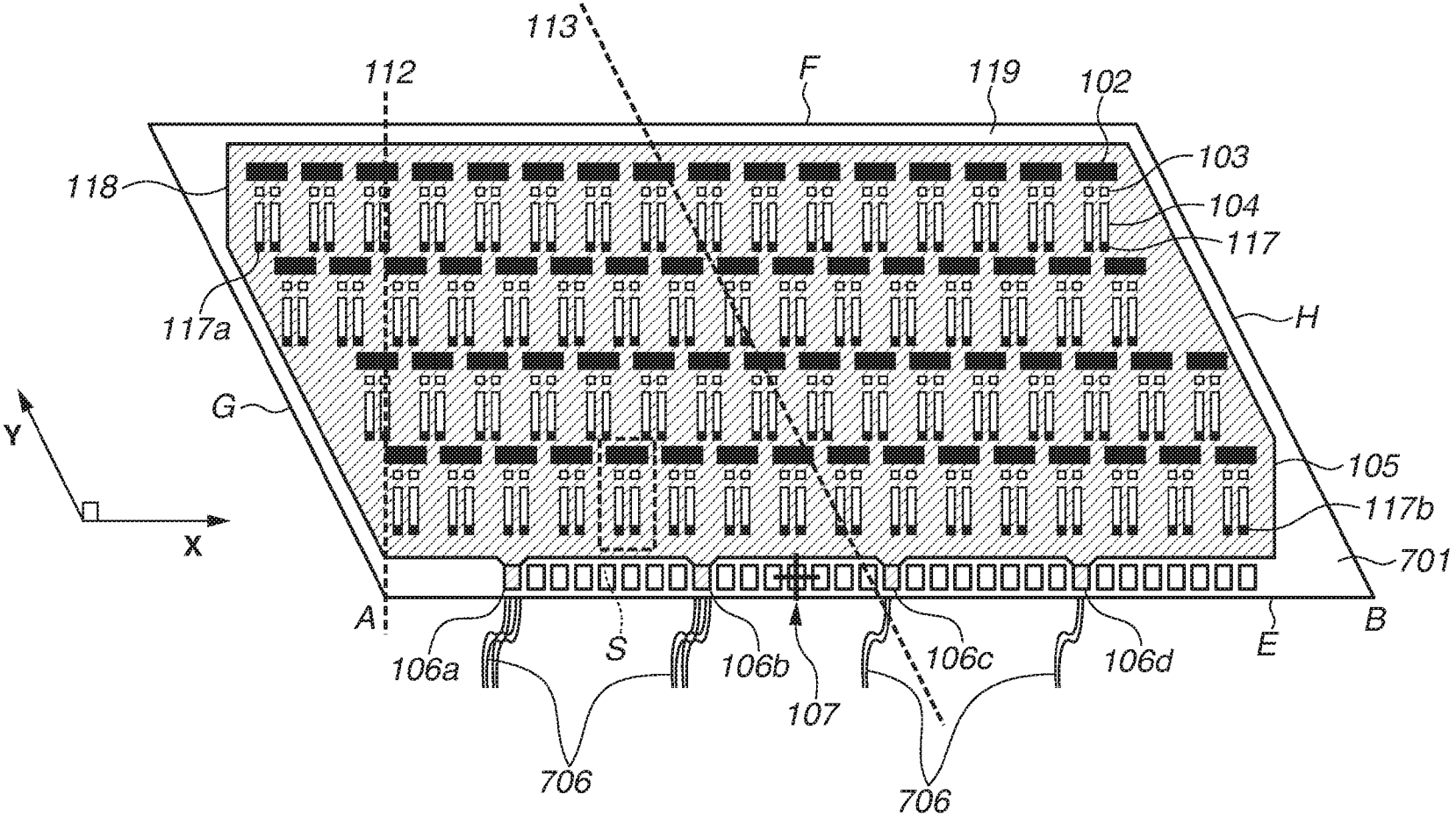
FIG. 11 is a top view illustrating a liquid discharge head substrate according to a third exemplary embodiment.

A third exemplary embodiment will be described below by taking the case illustrated in FIG. 11 as an example of a liquid discharge head substrate in which the number of external wiring lines to be connected to each of the power supply terminals 106 using wire bonding is made different. Suppose a case where external wire lines 706 are connected to the n power supply terminals 106, and Ni wiring lines 706 (Ni is a natural number equal to or larger than 1) are connected to the i-th power supply terminal 106 (i is a natural number from 1 to n inclusive). When the i-th power supply terminal 106 has a position coordinate Ci in the X direction, a coordinate Cc of the connection centroid of n power supply terminals 106 is defined by the following formula 4:

$$Cc = \frac{\sum_{i=1}^{n} NiCi}{\sum_{i=1}^{n} Ni}. \quad (4)$$

According to the present exemplary embodiment, the difference in the resistance values of the wiring 105 connected to the n power supply terminals 106 can be reduced by positioning the connection centroid of the n power supply terminals 106 calculated by the formula 4 at the same position as that of the position centroid Cm according to the first exemplary embodiment. Further, the difference in the amounts of voltage drop in the wiring 105 to be connected to the n power supply terminals 106 can be reduced.

More specifically, the liquid discharge head substrate can be configured as follows. FIG. 11 illustrates a case where n=4, N1=2, N2=2, N3=1, and N4=1. According to the present specification, the connection centroid means an electrical centroid defined in consideration of the positions of the n power supply terminals 106 to be connected to the wiring 105 and the number of external wire lines 706 to be connected to the power supply terminals 106.

The wiring 105 includes the plurality of connecting portions 117 each connected to a different one of the liquid discharge elements 103. The plurality of connecting portions 117 includes the connecting portion 117*a* having the highest resistance value to currents from the n power supply terminals, and the connecting portion 117*b* at the farthest position from the connecting portion 117*a*. When the connecting portion 117*a* has a position coordinate Ca and the connecting portion 117*b* has a position coordinate Cb, the n power supply terminals 106 are disposed in the X direction in such a manner that the absolute value of the difference between Ca and Cc becomes smaller than the absolute value of the difference between Cb and Cc. Thus, the distance in the X direction between the connection centroid of the n power supply terminals 106 and the connecting portion 117*a* having a high resistance value can be made smaller than the distance in the X direction between the connecting portion 117*b* at the farthest position from the connecting portion 117*a* and the connection centroid.

Similar to the liquid discharge head substrate 101, a liquid discharge head substrate 701 also has the first region 118 including the perpendicular line 112 drawn from the intersection A between the straight line including the first side E and the straight line including the third side G to the straight line including the second side F, and the third side G. The liquid discharge head substrate 701 also has the second region 119 including the perpendicular line 112 and the fourth side H. A part of the plurality of connecting portions 117 including the connecting portion 117*a* is disposed in the first region 118. In this case, the connection centroid of the n power supply terminals 106 having a position coordinate Cc in the X direction is disposed at a position closer to the third side G than to the fourth side H.

According to the configuration of the present exemplary embodiment, it becomes possible to design the drive element 104 in small size, and thus to downsize the liquid discharge head substrate 101. Also, according to the configuration of the present exemplary embodiment, the maximum amount of voltage drop in the connecting portions 117 can be reduced, and a large number of liquid discharge elements 103 can be therefore simultaneously driven. Consequently, the printing speed can be improved. Further, according to the configuration of the present exemplary embodiment, it becomes possible to reduce surplus power applied to the liquid discharge elements 103 coupled with the connecting portions 117 having a small amount of voltage drop, and which increases the life.

The power supply terminal 106 may be configured to be supplied with the ground potential or configured to be supplied with a high potential.

According to the present exemplary embodiment, the effect of reducing the difference in resistance values can be acquired even if the relation between the position centroid Cm and the connecting portions 117*a* and 117*b* according to the first and the second exemplary embodiments is not satisfied. Likewise, according to the first and the second exemplary embodiments, the effect can be acquired even if the relation between the connection centroid Cc and the connecting portions 117*a* and 117*b* according to the present exemplary embodiment is not satisfied.

A fourth exemplary embodiment will be described below about a relation between the position centroid 107 of the power supply terminals 106 to be connected to external wiring lines and the position centroid of power supply terminals 403 to be connected to external wiring lines. More specifically, in a liquid discharge head substrate 401 according to the present exemplary embodiment, the position centroid 107 of the power supply terminals 106 is closer to the third side G than the position centroid of the power supply terminals 116.

Figure 12:
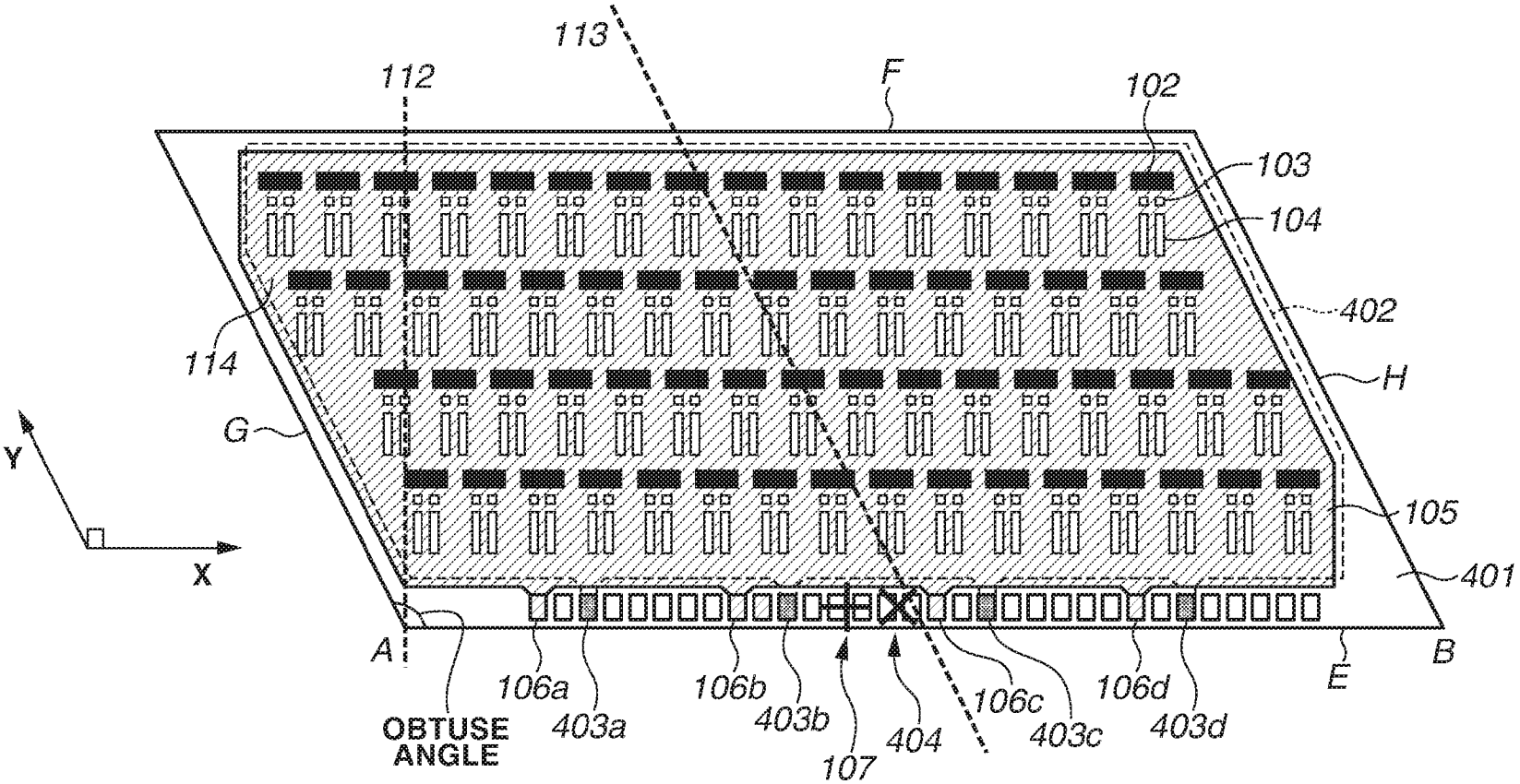
FIG. 12 is a top view illustrating another liquid discharge head substrate according to a fourth exemplary embodiment.

FIG. 12 is a top view illustrating the liquid discharge head substrate 401 according to the present exemplary embodiment. On the liquid discharge head substrate 401, the wiring 105 having a lattice shape, a wiring 402 also having a lattice shape, the power supply terminals 106, and the power supply terminals 403 are disposed. The power supply terminals 106 and the power supply terminals 403 are disposed along the first side E. The power supply terminals 106 include the power supply terminals 106*a* to 106*d*, and the power supply terminals 403 includes power supply terminals 403*a* to 403*d*. A position centroid 404 is the position centroid of the power supply terminals 403*a* to 403*d*. According to the present exemplary embodiment, the power supply terminals 106 are supplied with the ground potential, and the power supply terminals 403 are supplied with a high potential such as 32V.

In a drive circuit in switching driving, a voltage drop by the resistance of the wiring 105 supplied with the ground potential increases the source voltage of the drive circuit and decreases the voltage between the gate and the source terminals. Accordingly, the ON resistance value of the drive circuit changes. As in the present exemplary embodiment, the resistance value of the wiring 105 can be preferentially lowered by disposing the position centroid 107 of the power supply terminals 106 closer to the side of the third side G than the position centroid 404 of the power supply terminals 403. According to this configuration, it becomes possible to lower not only the resistance values in the wiring 105 but also the ON resistance value of the drive elements 104. Consequently, the printing speed can be improved, the life of the heater can be increased, and the liquid discharge head substrate can be downsized.

Figure 13A:
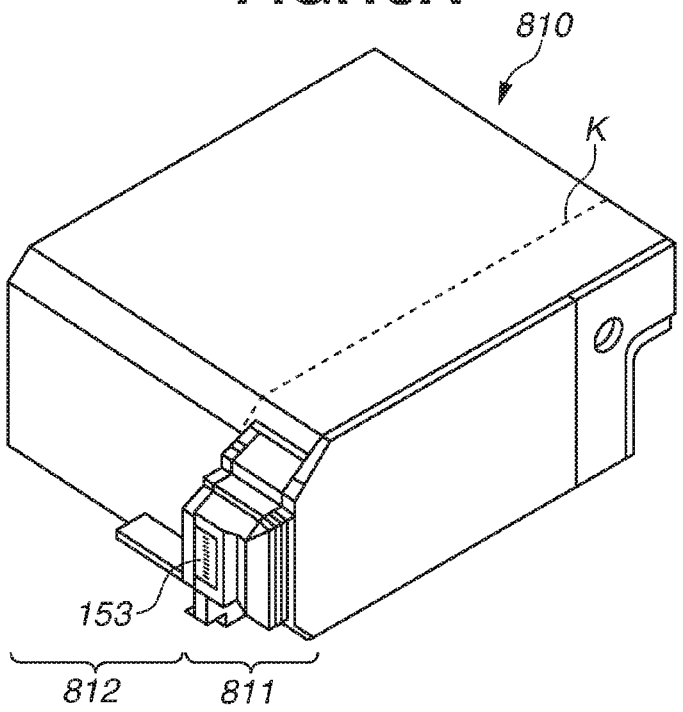
FIGS. 13A and 13B are diagrams illustrating an example of an application of a liquid discharge head substrate.
Figure 13B:
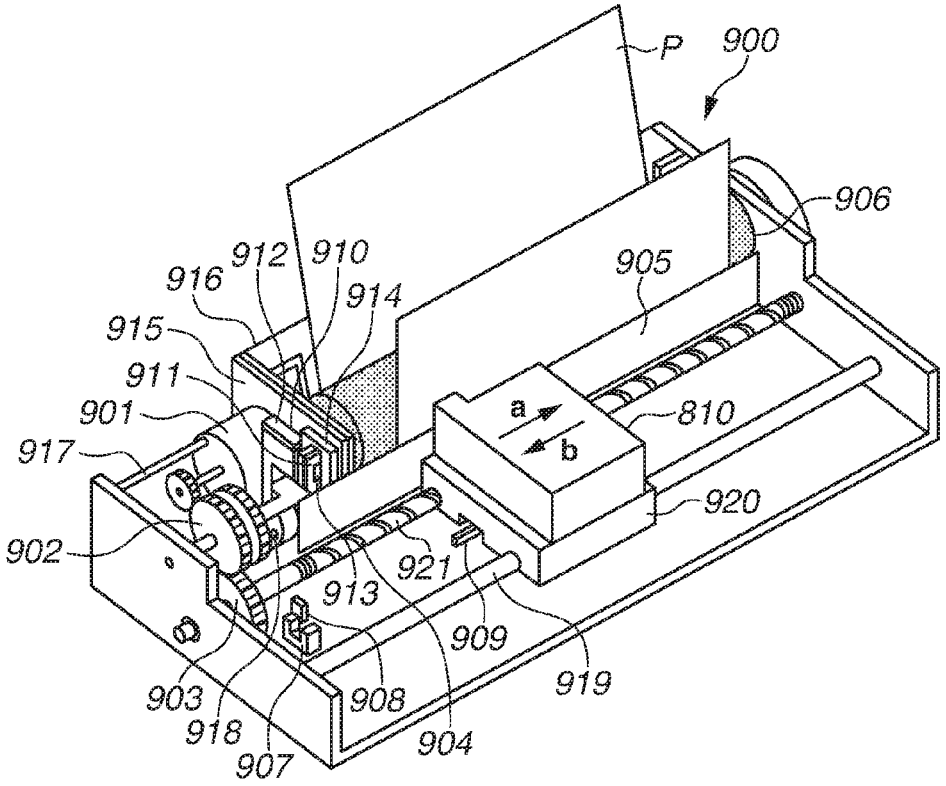

FIGS. 13A and 13B illustrate an example of the above-described liquid discharge head substrate mounted in an ink-jet recording apparatus. The form of the recording apparatus is not limited thereto. For example, a thermal transfer recording apparatus of the melting or sublimation type is also applicable. The recording apparatus may be a single function printer having only a recording function or a multifunction printer having a plurality of functions, such as a recording function, a facsimile function, and a scanner function. The recording apparatus may also be a manufacturing apparatus for manufacturing color filters, electronic devices, optical devices, or micro structures, based on a predetermined recording method.

The term "recording" may include not only forming an image, design, pattern, structure, and other objects actualized to be perceivable by the human vision, on a recording medium but also processing a medium. The term "recording medium" may include not only paper used with a common recording apparatus but also a cloth, plastic film, metal plate, glass, ceramics, resin, wood, leather, and other materials to which a recording agent is applicable. The term "recording agent" may include not only a liquid, such as ink, to be provided to form an image, design, pattern, etc. for process of a recording medium, by being applied to a recording medium but also a liquid to be provided to process a recording agent (for example, solidification or insolubilization of a coloring material contained in the recording agent).

FIG. 13A illustrates an example appearance of a liquid discharge head unit 810. The liquid discharge head unit 810 includes, for example, a liquid discharge head 811 and an ink tank 812 attached to the liquid discharge head 811. The liquid discharge head unit 810 includes a liquid discharge head substrate and a plurality of nozzles 153 disposed to face the liquid discharge head substrate. As a liquid discharge heard substrate, the liquid discharge head substrate according to any one of the first to the fourth exemplary embodiments is applicable.

The ink tank 812 stores ink to be supplied to the liquid discharge head 811. The ink tank 812 and the liquid discharge head 811 can be separated at a broken line K to allow the replacement of the ink tank 812.

The liquid discharge head unit 810 is provided with electrical contacts (not illustrated) for receiving an electrical signal from a carriage 920 (see FIG. 13B), and discharges ink according to the electrical signal to perform the above-described recording. In the ink tank 812, for example, a fibrous or porous ink holding material (not illustrated) is provided to hold ink.

FIG. 13B is a perspective view illustrating a recording apparatus 900. The liquid discharge head unit 810 is the liquid discharge head 811 partly illustrated in FIG. 13A, and can be mounted on the carriage 920 together with the ink tank 812 (recording agent container). The carriage 920 can be attached to a lead screw 904 having a spiral slot 921. The rotation of the lead screw 904 allows the liquid discharge head unit 810 to move together with the carriage 920 in the direction of an arrow a or b along with a guide 919. The rotation of the lead screw 904 associates with the rotation of a drive motor 901 via driving force transfer gears 902 and 903.

Recording paper P can be conveyed onto a platen 906 by a conveyance unit (not illustrated). A paper pressing plate 905 can press recording paper P onto the platen 906 along the moving direction of the carriage 920. The recording apparatus 900 checks the position of a lever 909 provided in the carriage 920 via photocouplers 907 and 908, and can change the rotational direction of the drive motor 901. A supporting member 910 can support a cap member 911 for capping each nozzle of the liquid discharge head unit 810. A suction unit 912 absorbs the inside of the cap member 911 and can perform suction recovery processing on the liquid discharge head unit 810 via an opening 913 in the cap member 911.

For a cleaning blade 914, a known cleaning blade is used. The cleaning blade 914 can be moved back and forth by a moving member 915. A main body supporting plate 916 can support the moving member 915 and the cleaning blade 914. A lever 917 can be provided to start the suction recovery processing.

The lever 917 moves with the movement of a cam 918 which engages with the carriage 920. The driving force from the drive motor 901 can be controlled by a known transmission unit, such as a clutch change. The recording apparatus 900 includes a recording control unit (not illustrated) and can control drive of each mechanism according to an electrical signal, such as recording data from the outside. The recording apparatus 900 repeats the reciprocal movement of the liquid discharge head unit 810 and the conveyance of the recording paper P by the conveyance unit (not illustrated), to complete recording on the recording paper P.

The recording apparatus 900 can have three-dimensional (3D) data and also be used as an apparatus for forming a three-dimensional image.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-130908, filed Jun. 30, 2016, which is hereby incorporated by reference herein in its entirety.

What is claimed is:

1. A liquid discharge head substrate comprising:

a substrate having at least a first side and a second side extending along a first direction, and a third side and a fourth side extending along a second direction intersecting with the first direction;

a plurality of liquid discharge elements disposed on the substrate;

a plurality of power supply terminals disposed along the first side of the substrate; and a first wiring, having a lattice shape, connected to the plurality of power supply terminals, wherein, on the substrate, the first and the third sides form an obtuse angle, and the first and the fourth sides form an acute angle, and wherein, in the plurality of power supply terminals, the number of power supply terminals at positions closer to the third side than to the fourth side is larger than the number of power supply terminals at positions closer to the fourth side than to the third side.

2. The liquid discharge head substrate according to claim 1, further comprising a second wiring, having a lattice shape, connected to at least one power supply terminal other than the plurality of power supply terminals, and supplied with a potential different from a potential of the first wiring, wherein the at least one power supply terminal is positioned closer to the third side than to the fourth side.

3. The liquid discharge head substrate according to claim 1, wherein the first wiring includes a plurality of connecting portions each of which is connected to a different one of the plurality of liquid discharge elements, and wherein at least one of the plurality of connecting portions is positioned closer to the third side than to the fourth side.

4. The liquid discharge head substrate according to claim 1, wherein the substrate is a parallelogram.

5. The liquid discharge head substrate according to claim 1, wherein the first wiring includes a plurality of connecting portions each of which is connected to a different one of the liquid discharge elements, wherein the plurality of connecting portions includes a first connecting portion having a highest resistance value to currents from the plurality of power supply terminals, and a second connecting portion at a position farthest from the first connecting portion, and wherein an absolute value of a difference between Ca and Cm is smaller than an absolute value of a difference between Cb and Cm, where Cm is a position coordinate, of a position centroid of the plurality of power supply terminals, obtained by dividing a sum of position coordinates of the plurality of power supply terminals by the number of the plurality of the power supply terminals, Ca is a position coordinate of the first connecting portion, and Cb is a position coordinate of the second connecting portion.

6. The liquid discharge head substrate according to claim 5, wherein the plurality of connecting portions is a part of the first wiring, and is a portion to be connected to another wiring or a portion to be connected to contact plugs for connection with another wiring.

7. The liquid discharge head substrate according to claim 1, wherein the first wiring includes a plurality of connecting portions each of which is connected to a different one of the liquid discharge elements, and wherein the plurality of connecting portions includes a first connecting portion having a highest resistance value to currents from the plurality of power supply terminals, and a second connecting portion at a position farthest from the first connecting portion, wherein a connection centroid Cc of the n power supply terminals is represented by the following formula:

$$Cc = \frac{\sum_{i=1}^{n} NiCi}{\sum_{i=1}^{n} Ni}, \quad (1)$$

where n is the number of the plurality of power supply terminals and is a natural number equal to or larger than 1, Ni is the number of external wiring lines connected to an i-th power supply terminal of the plurality of power supply terminals, i being a natural number from 1 to n or less, and Ci is a position coordinate of the i-th power supply terminal in the first direction, and wherein an absolute value of a difference between Ca and Cc is smaller than an absolute value of a difference between Cb and Cc, where Ca is a position coordinate of the first connecting portion and Cb is a position coordinate of the second connecting portion.

8. The liquid discharge head substrate according to claim 1, wherein the plurality of power supply terminals is a plurality of ground terminals.

9. The liquid discharge head substrate according to claim 1, wherein one end of the liquid discharge element is connected to the first wiring via a first drive element.

10. The liquid discharge head substrate according to claim 1, wherein the lattice shape is a planar shape having a plurality of openings.

11. A liquid discharge head comprising:

a plurality of nozzles; and the liquid discharge head substrate according to claim 1 facing the plurality of nozzles.

12. A recording apparatus comprising:

the liquid discharge head according to claim 11; and an ink tank attached to the liquid discharge head.

13. A liquid discharge head substrate comprising:

a substrate having at least a first side and a second side extending along a first direction, and a third side and a fourth side extending along a second direction intersecting with the first direction;

a plurality of liquid discharge elements disposed on the substrate;

a plurality of power supply terminals disposed along the first side of the substrate; and a first wiring, having a lattice shape, connected to n power supply terminals of the plurality of power supply terminals, n being a natural number equal to or larger than 1, wherein the first wiring includes a plurality of connecting portions each of which is connected to a different one of the plurality of liquid discharge elements, wherein the substrate includes:

a first region of which outer edges include a perpendicular line drawn from an intersection between a straight line including the first side and a straight line including the third side to a straight line including the second side, and the third side, and a second region of which outer edges include the perpendicular line and the fourth side, wherein at least one of the plurality of connecting portions is disposed in the first region, wherein, in the first direction, a position centroid of the n power supply lines has a position coordinate Cm obtained by dividing a sum of position coordinates of the n power supply terminals by n, and wherein the position centroid having the position coordinate Cm is disposed at a position closer to the third side than to the fourth side.

14. The liquid discharge head substrate according to claim 13, wherein the perpendicular line drawn from the intersection between the straight line including the first side and the straight line including the third side to the straight line including the second side intersects the second side.

15. The liquid discharge head substrate according to claim 13, wherein, in the n power supply terminals, the number of the power supply terminals disposed at positions closer to the third side than to the fourth side is larger than the number of the power supply terminals disposed at positions closer to the fourth side than to the third side.

16. The liquid discharge head substrate according to claim 13, wherein the substrate is a parallelogram.

17. The liquid discharge head substrate according to claim 13, wherein the n power supply terminals are ground terminals.

18. The liquid discharge head substrate according to claim 13, wherein the plurality of connecting portions is a part of the first wiring, and is a portion to be connected to another wiring or a portion to be connected to contact plugs for connection with another wiring.

19. The liquid discharge head substrate according to claim 13, wherein the lattice shape is a planar shape having a plurality of openings.

20. A liquid discharge head comprising:

a plurality of nozzles; and the liquid discharge head substrate according to claim 13 facing the plurality of nozzles.

21. A recording apparatus comprising:

the liquid discharge head according to claim 20; and an ink tank attached to the liquid discharge head.

22. A liquid discharge head substrate comprising:

a substrate having at least a first side and a second side extending along a first direction, and a third side and a fourth side extending along a second direction intersecting with the first direction;

a plurality of liquid discharge elements disposed on the substrate;

a plurality of power supply terminals disposed along the first side of the substrate; and a first wiring, having a lattice shape, connected to n power supply terminals of the plurality of power supply terminals, n being a natural number equal to or larger than 1, wherein the first wiring includes a plurality of connecting portions each of which is connected to a different one of the plurality of liquid discharge elements, wherein the substrate includes:

a first region of which outer edges include a perpendicular line drawn from an intersection between a straight line including the first side and a straight line including the third side to a straight line including the second side, and the third side, and a second region of which outer edges include the perpendicular line and the fourth side, wherein at least one of the plurality of connecting portions is disposed in the first region, and wherein a position coordinate Cc of a connection centroid of the n power supply terminals is represented by the following formula:

$$Cc = \frac{\sum_{i=1}^{n} NiCi}{\sum_{i=1}^{n} Ni}, \quad (2)$$

where Ni is the number of external wiring lines connected to an i-th power supply terminal of the n power supply terminals, i being a natural number from 1 to n inclusive, and Ci is a position coordinate of the i-th power supply terminal, and wherein the connection centroid, of the n power supply terminals, having the position coordinate Cc is disposed at a position closer to the third side than to the fourth side.

23. The liquid discharge head substrate according to claim 22, wherein the perpendicular line drawn from the intersection between the straight line including the first side and the straight line including the third side to the straight line including the second side intersects the second side.

24. The liquid discharge head substrate according to claim 22, wherein, in the n power supply terminals, the number of the power supply terminals disposed at positions closer to the third side than to the fourth side is larger than the number of the power supply terminals disposed at positions closer to the fourth side than to the third side.

25. The liquid discharge head substrate according to claim 22, wherein the substrate is a parallelogram.

26. The liquid discharge head substrate according to claim 22, wherein the n power supply terminals are ground terminals.

27. The liquid discharge head substrate according to claim 22, wherein the plurality of connecting portions is a part of the first wiring, and is a portion to be connected to another wiring or a portion to be connected to contact plugs for connection with another wiring.

28. The liquid discharge head substrate according to claim 22, wherein the lattice shape is a planar shape having a plurality of openings.

29. A liquid discharge head comprising:

a plurality of nozzles; and the liquid discharge head substrate according to claim 22 facing the plurality of nozzles.

30. A recording apparatus comprising:

the liquid discharge head according to claim 29; and an ink tank attached to the liquid discharge head.

* * * * *